US007316045B2

(12) United States Patent
Koke

(10) Patent No.: US 7,316,045 B2
(45) Date of Patent: Jan. 8, 2008

(54) HAIR BRUSH INCLUDING HAIR REMOVAL MEANS

(76) Inventor: Eric John Koke, 302 S. Broadway, Wind-Gap, PA (US) 18091

( * ) Notice: Subject to any disclaimer, the term of this patent is extended or adjusted under 35 U.S.C. 154(b) by 419 days.

(21) Appl. No.: 10/888,605

(22) Filed: Jul. 9, 2004

(65) Prior Publication Data

US 2005/0051187 A1 Mar. 10, 2005

Related U.S. Application Data

(60) Provisional application No. 60/485,788, filed on Jul. 10, 2003.

(51) Int. Cl.
*A46B 17/06* (2006.01)

(52) U.S. Cl. ..... 15/169; 15/186; 132/119; 132/120

(58) Field of Classification Search ..... 15/169, 15/184–188, 201–203; 132/119, 120
See application file for complete search history.

(56) References Cited

U.S. PATENT DOCUMENTS

| | | | | |
|---|---|---|---|---|
| 1,050,103 | A | 1/1913 | Clemens | |
| 1,164,204 | A | 12/1915 | Mullett et al. | |
| 1,290,554 | A | 1/1919 | Healey | |
| 2,482,928 | A * | 9/1949 | Neff et al. | 601/137 |
| 2,529,927 | A | 11/1950 | Fisk | |
| 3,108,305 | A | 10/1963 | Peilet | |
| 3,110,053 | A | 11/1963 | Surabian | |
| 4,517,703 | A | 5/1985 | Koke | |
| 5,519,912 | A * | 5/1996 | Kawamura | 15/160 |
| 5,600,865 | A | 2/1997 | Morrison | |
| 5,862,563 | A * | 1/1999 | Hartmann | 15/169 |
| 5,904,150 | A * | 5/1999 | Caristo et al. | 132/119 |
| 6,021,542 | A * | 2/2000 | Norman | 15/169 |

FOREIGN PATENT DOCUMENTS

EP 289465 * 11/1988

* cited by examiner

*Primary Examiner*—Mark Spisich
(74) *Attorney, Agent, or Firm*—Arthur L. Lessler

(57) ABSTRACT

A hair brush having a handle and a body portion with a recess having a convex bottom surface. A similarly curved bristle retaining plate has bristle retaining holes with one bristle slidably installed in each hole. Each bristle has an enlarged bulbous upper end and a wedge-shaped lower end so that it can slide through the bristle retaining plate between its ends. The holes have chamfers at the bottom surface of the plate, and the wedge-shaped ends of the bristles are dimensioned so as to fit in the chamfers. A similarly curved hair removal plate with bristle receiving holes is placed atop the bristle retaining plate, and detachably retained in position. To clean the brush, the hair removal plate is removed from the bristle retaining plate, and the bristle retaining plate is removed from the recess and turned to cause the bristles to slide in the holes so that their bulbous ends contact the bristle retaining plate. Thereafter the plates are returned to their original positions. In a second embodiment the bristle retaining plate may be hinged to the body portion of the brush at one end of the recess, and latched to the body portion at the opposite end of the recess; and the hair removal plate is not used.

10 Claims, 13 Drawing Sheets

HAIR BRUSH INCLUDING HAIR REMOVAL MEANS

CROSS-REFERENCE TO RELATED APPLICATION

This application claims the benefit of U.S. Provisional Application Ser. No. 60/485,788 filed Jul. 10, 2003 and entitled Superclean Hair Brush.

BACKGROUND OF THE INVENTION

This invention relates to a hair brush of the type having a member slidably moveable along the bristles thereof, for the purpose of cleaning the brush by removing hair therefrom.

Hair brushes of this type, for use on both humans and animals, are well known in the art. Such brushes are exemplified by U.S. Pat. No. 5,600,865 to Morrison; U.S. Pat. No. 4,517,703 to the inventor in the present application, U.S. Pat. No. 2,529,927 to Fisk; U.S. Pat. No. 3,108,305 to Peilet; U.S. Pat. No. 3,110,053 to Surabian; U.S. Pat. No. 1,290,554 to Healey; U.S. Pat. No. 1,050,103 to Clemens; and U.S. Pat. No. 1,164,204 to Mullett et al.

In the arrangement of Fisk a foraminous cleaning plate 11 has holes through which the bristles extend. The cleaning plate is slidably movable along the bristles, and is prevented from being removed from the ends of the bristles by hooks 13 which are secured to opposite ends of the cleaning plate and which also engage the base of the brush. The other arrangements described in the aforementioned references (other than the prior patent of the inventor herein) similarly employ various mechanisms to limit the movement of the cleaning plate, and some employ additional mechanisms to return the cleaning plate to its rest position adjacent the base of the brush.

Such prior art arrangements are relatively complex and expensive to manufacture, and are susceptible to jamming and other mechanical malfunctions.

In the inventor's prior U.S. Pat. No. 4,517,703 a laminated cleaning plate is used which has a resilient layer with holes that tightly grip the bristles but which enlarge when moved to the bristle tips, so that the plate can be removed from the bristles while preventing strands of hair from staying on the bristles. However, this arrangement is not as easy to use as is desired, and requires a considerable amount of force to be applied to remove the cleaning plate. It is not suitable for making a hair brush with bristles which are not all parallel to each other, but which extend outward in a generally radial manner, as if preferred by most users of hair brushes.

Accordingly, an object of the present invention is to provide an improved hair brush including effective hair removal means which is easy to operate.

SUMMARY OF THE INVENTION

A hair brush is provided which has an arrangement for removing hair from it. The brush has a frame with an arcuate surface portion. An arcuate bristle retaining plate has a frame engaging major surface which conforms to the shape of, and is adapted to overlie the arcuate surface portion of the frame. The plate has multiple bristle receiving holes through it, with an elongated generally cylindrical bendable bristle slidably mounted in each of the holes.

Each bristle has an enlarged end adjacent a frame engaging lower surface of the plate, and an enlarged bulbous end adjacent an upper surface of the plate, each end having a diameter slightly greater than that of the corresponding hole, so that each bristle may slide within the corresponding hole until one of its ends engages an adjacent major surface of said bristle retaining plate.

The bristle retaining plate is secured to the frame with the arcuate frame engaging major surface thereof disposed in juxtaposition with the arcuate surface portion of the frame. The bristle retaining plate can be disengaged from the frame to facilitate removal of hair from the plate and bristles. When the plate is disengaged from the frame, the bristles may slide through the corresponding holes in the bristle retaining plate until the bulbous ends engage the upper major surface of the bristle retaining plate, and may also slide through the corresponding holes in the bristle retaining plate until the frame engaging ends engage the corresponding holes in the bristle retaining plate so as to facilitate re-positioning of the frame engaging surface of the bristle retaining plate in juxtaposition with the arcuate portion of the brush frame.

An optional arcuate hair removal plate with holes which align with the holes in the bristle retaining plate may be positioned atop the bristle retaining plate so that the bristles extend through coinciding holes in both plates.

The bristle retaining plate is preferably hinged to the brush frame at one edge and latched to it at an opposite edge, so that hair can be removed by releasing the latch, rotating the bristle retaining plate (and the hair removal plate, if one is used) away from the frame about the hinge, removing and replacing the hair removal plate, if one is used, returning the plate (or plates) to the original position, and re-engaging the latch.

IN THE DRAWING

Figure 8A:
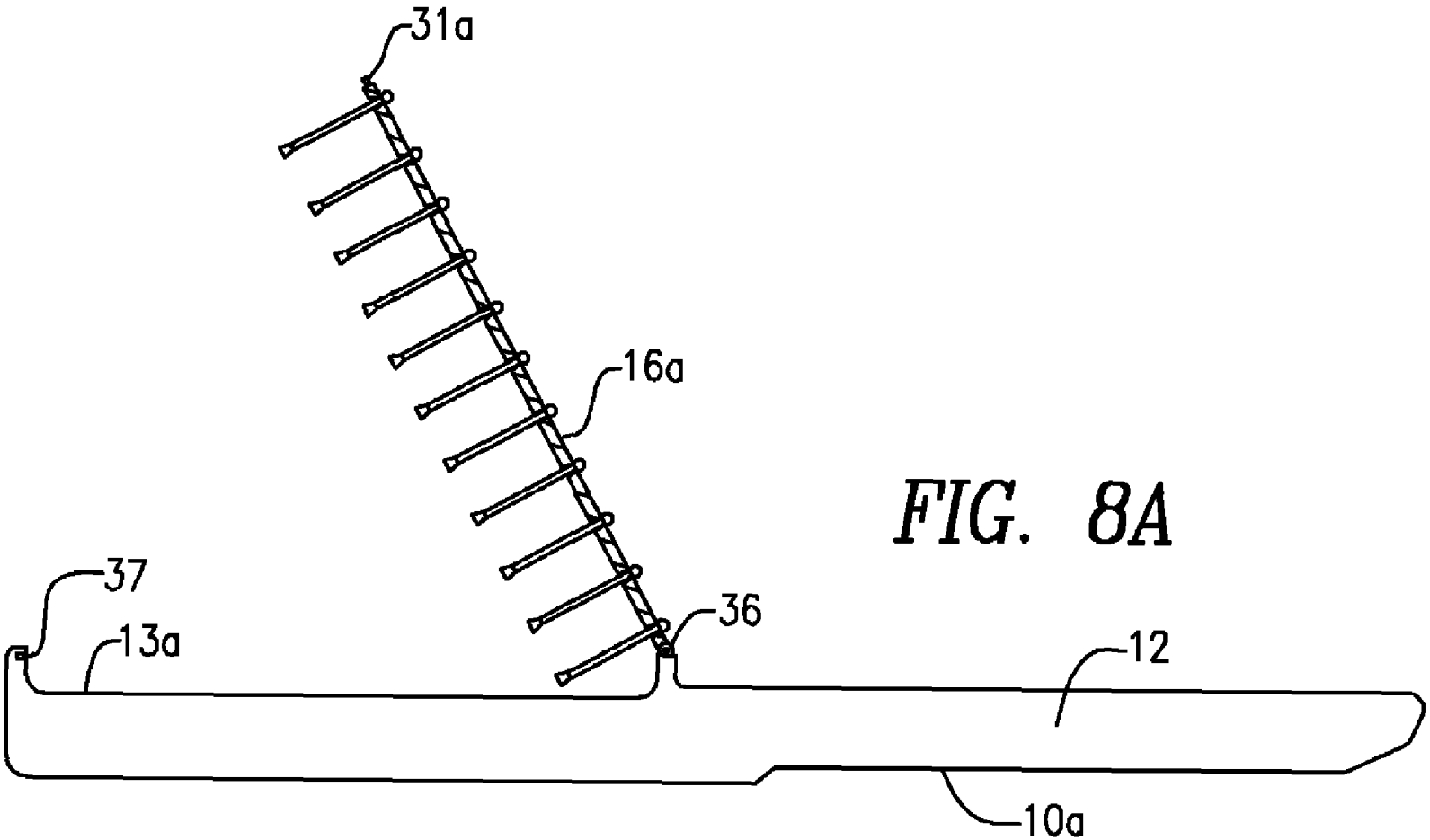
FIG. 8A is a side elevation view of a hair brush according to a second embodiment of the invention, namely a brush similar to that shown in FIGS. 1, 4A and 6 but in which the hair removal plate is omitted and the bristle retaining plate is hinged to the frame.
Figure 8B:
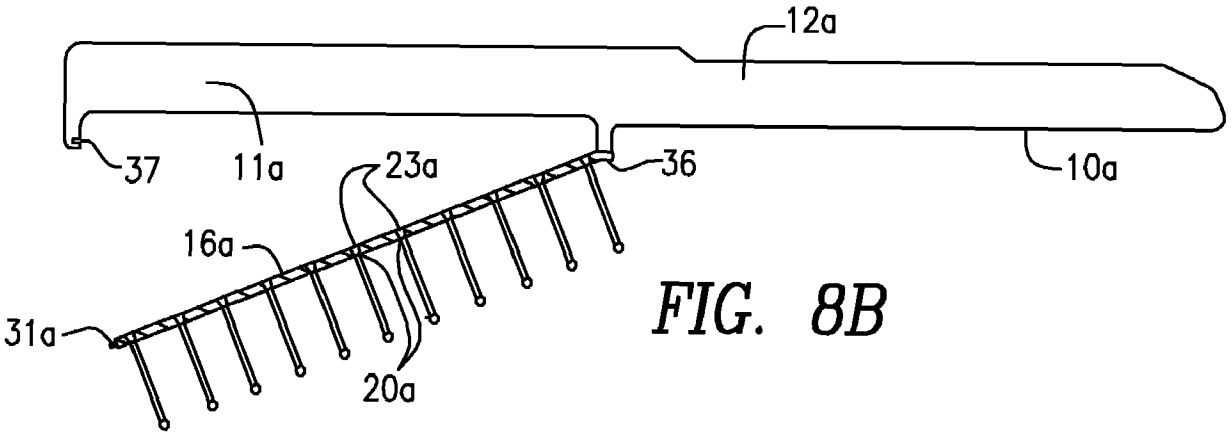
Figure 8C:
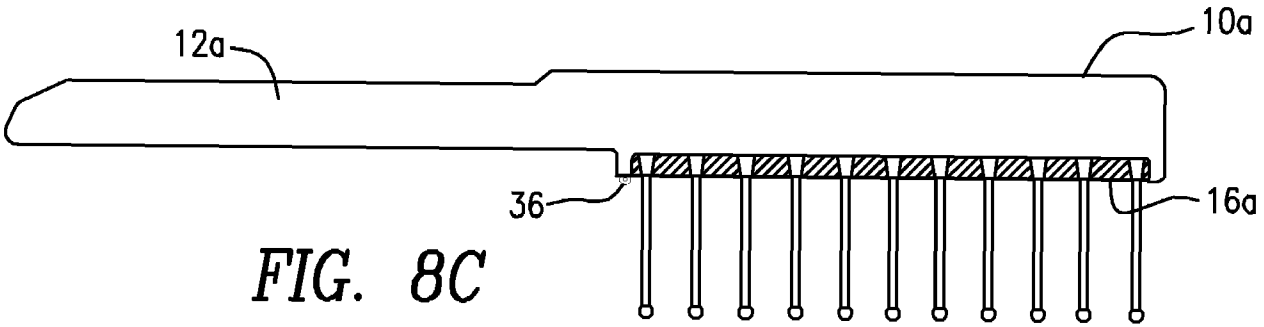

FIG. 8B is a side elevation view of the hair brush of FIG. 8A with the bristle retaining plate disengaged from the recess of the hair brush frame, the brush inverted, and the bristles having completely fallen through said plate; and FIG. 8C is a side elevation view of the hair brush of FIGS. 8A and 8B, with the brush inverted and the bristle retaining plate re-engaged with the recess of the hair brush frame.

DETAILED DESCRIPTION

Figure 1:
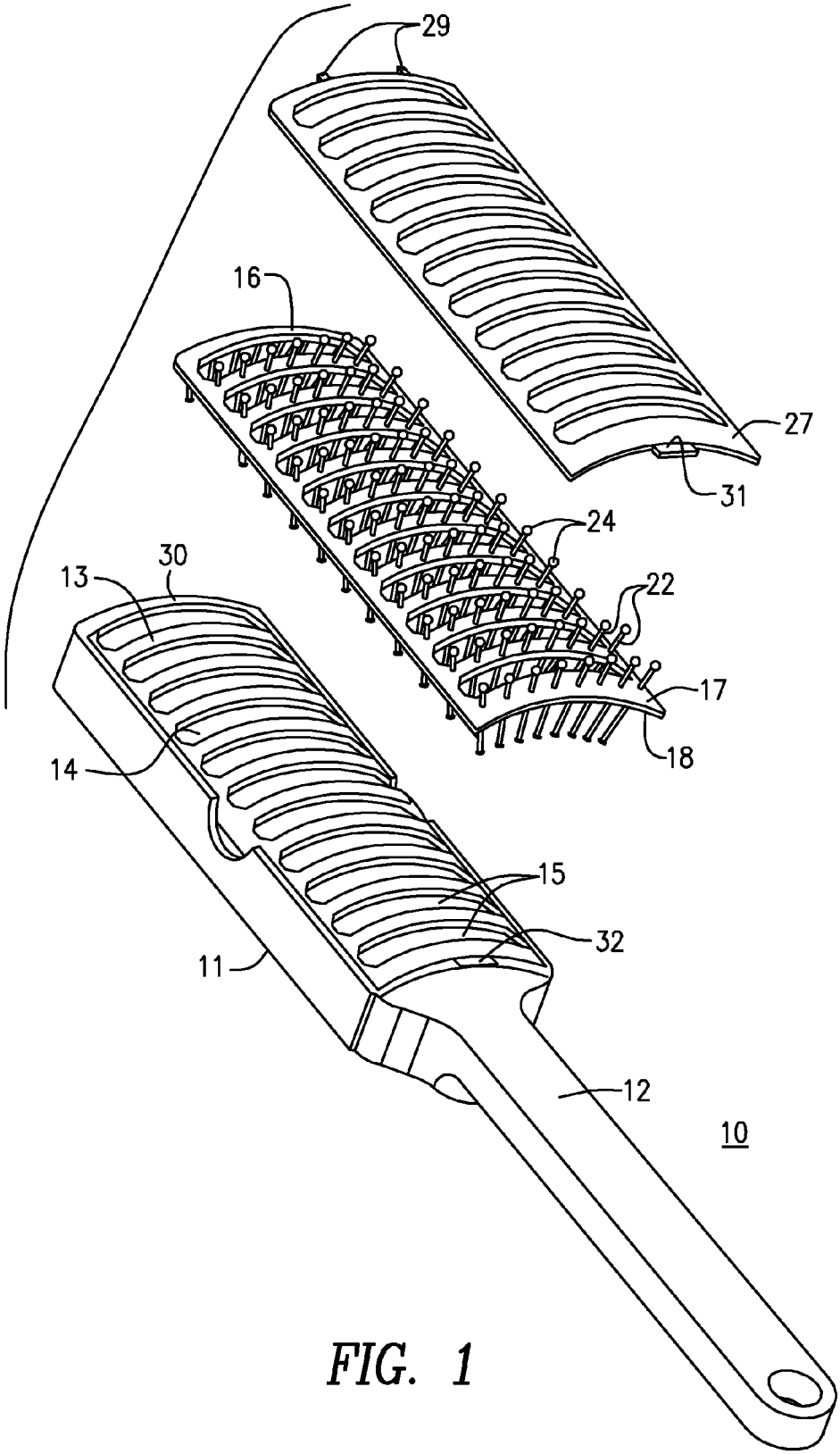
FIG. 1 is an exploded isometric view of a hair brush according to a first embodiment of the invention.
Figure 2:
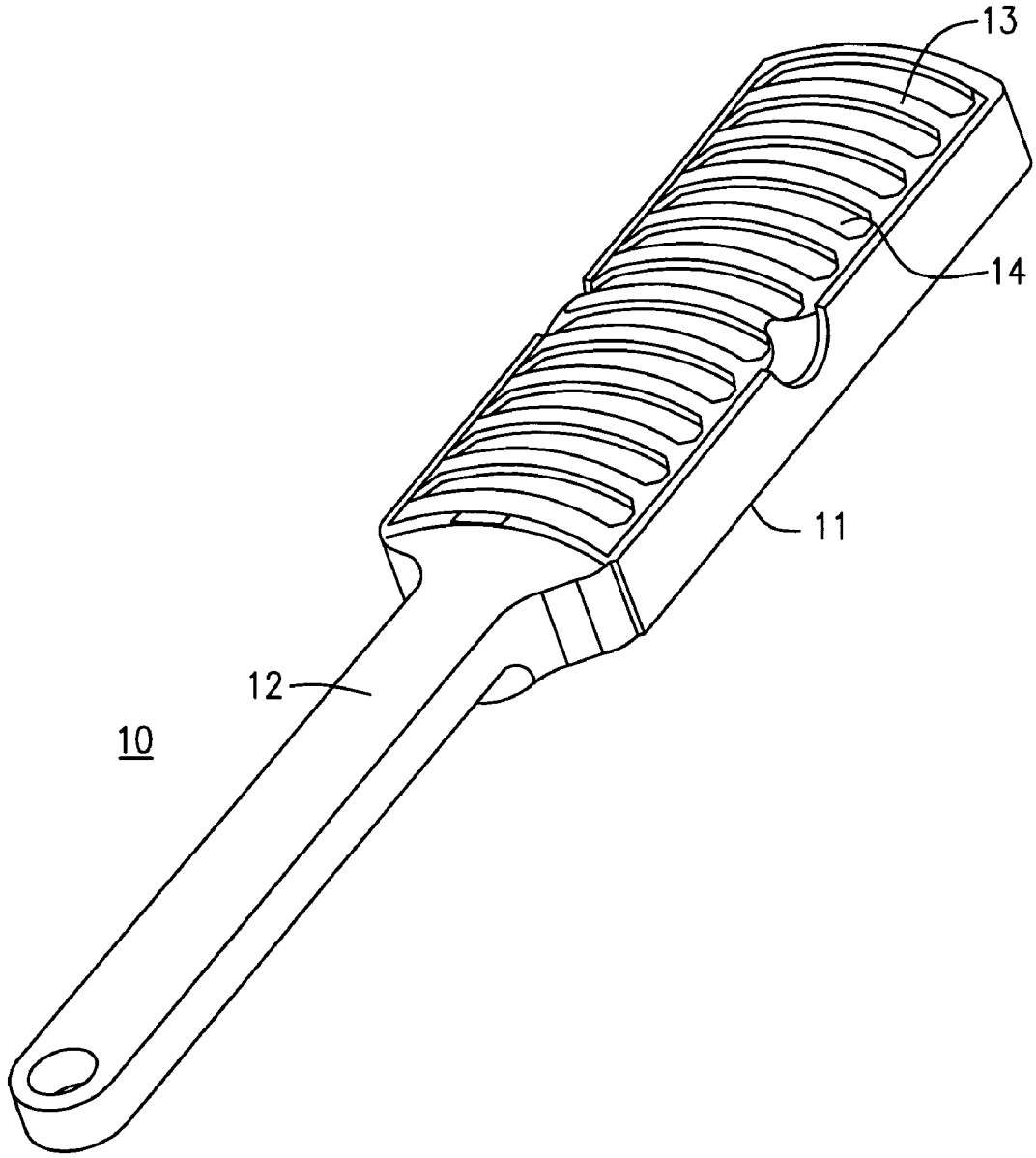
FIG. 2 is an isometric view of the frame of said hair brush.
Figure 3A:
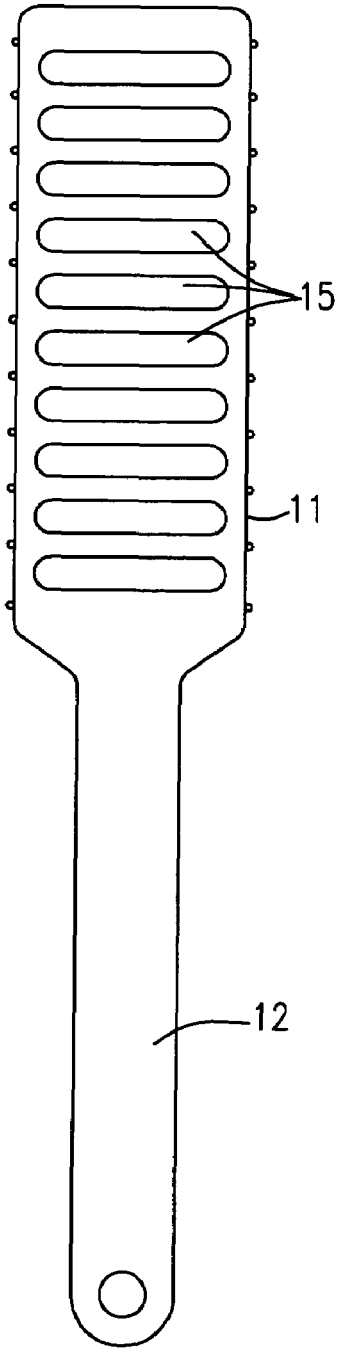
FIG. 3A is a bottom plan view of the hair brush shown in FIG. 1.
Figure 3B:
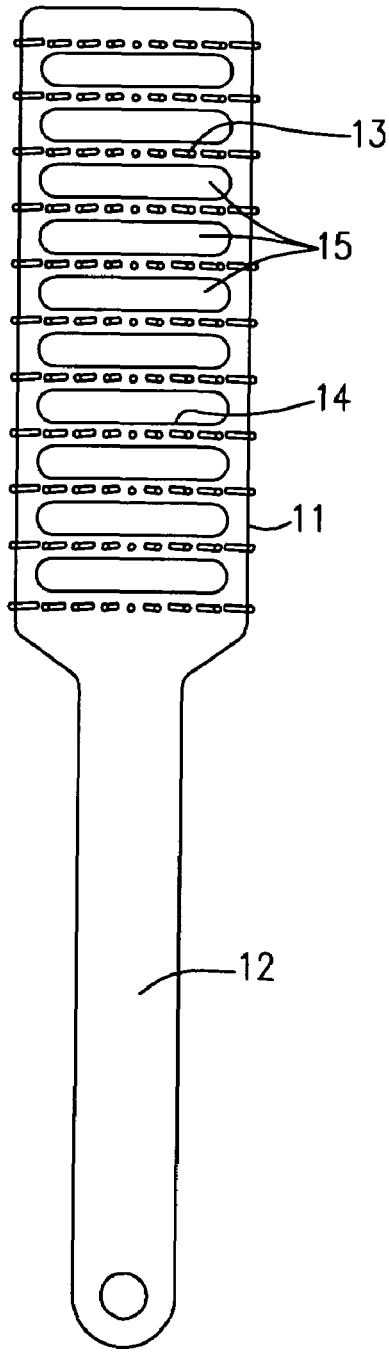
FIG. 3B is a top plan view of the hair brush shown in FIG. 1.
Figure 4:
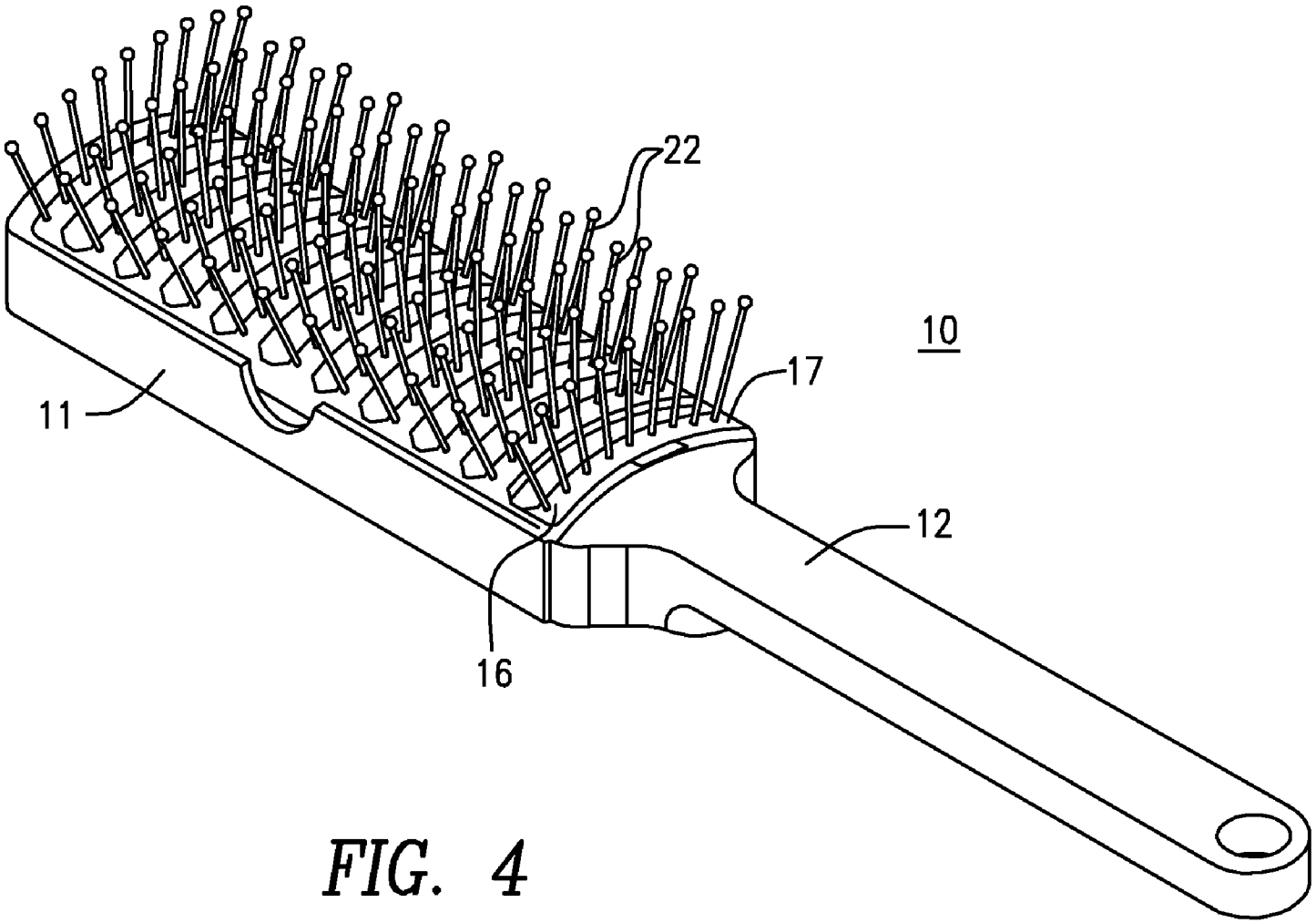
FIG. 4 is an isometric view of the hair brush shown in FIG. 1.
Figure 4A:
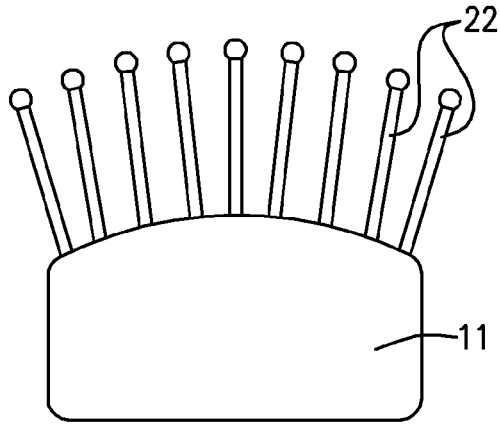
FIG. 4A is a side elevation view of the end of the hair brush shown in FIG. 4A which is remote from the handle thereof.
Figure 6:
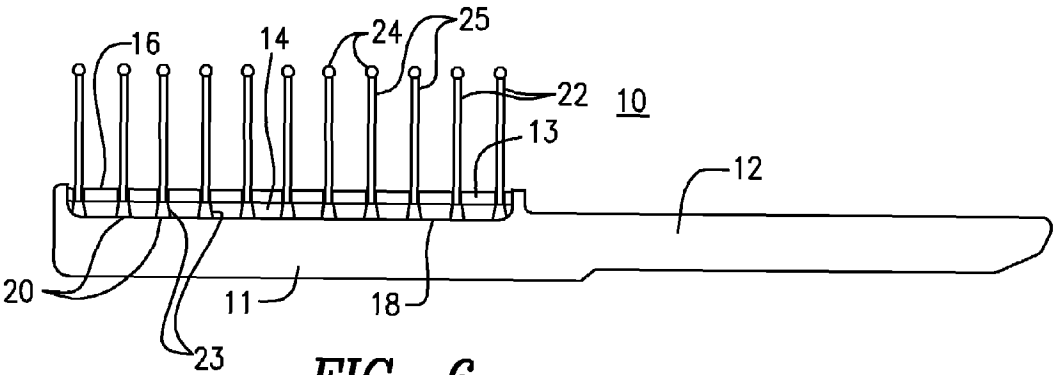
FIG. 6 is a side elevation cross-sectional view of the hair brush shown in FIGS. 1 and 4A.
Figure 6A:
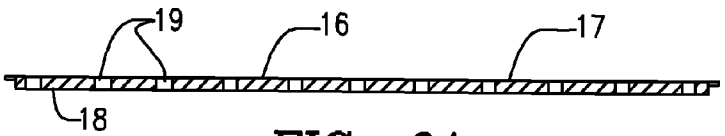
FIG. 6A is a side cross-sectional elevation view of the bristle retaining plate of the hair brush shown in FIG. 6, shown without the bristles.
Figure 6B:
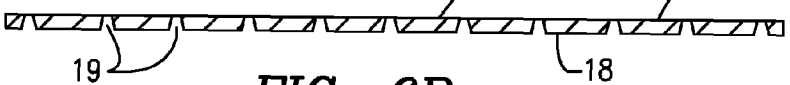
FIG. 6B is a front elevation cross-sectional view of the bristle retaining plate of the hair brush shown in FIG. 6, shown without the bristles.
Figure 6C:
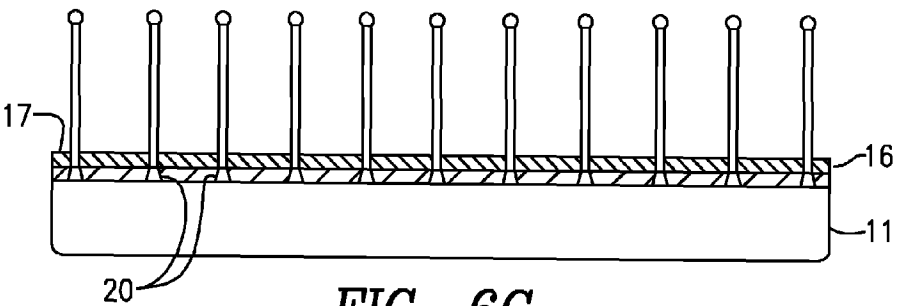
FIG. 6C is a front elevation cross-sectional view of the bristle retaining plate of the hair brush shown in FIG. 6 and the bristle retaining plate, with the bristle retaining plate engaging the plate retention recess of the frame of the brush.

As seen in FIGS. 1, 4 and 6, the hair brush 10 has a body portion 11 and a handle 12. The body portion 11 has a recess 13, the bottom surface 14 of which has a curved or arcuate generally convex shape. A series of parallel slots or vents 15 extends between the major surfaces of the recess 13.

A bristle retaining plate 16 has an arcuate shape conforming to the shape of the bottom surface 14 of the recess 13, an upper major surface 17 and a lower or frame recess engaging surface 18 which rests on and contacts the convex bottom surface 14 of the recess 13.

A multiplicity of bristle receiving holes 19 extends between the bristle retaining plate major surfaces 17 and 18. At the bottom surface 18 of the bristle retaining plate 16 the holes 19 have chamfers 20. At the upper surface 17 of the plate, the holes are surrounded by lands 21 which help to maintain bristles disposed in the holes, in an orientation perpendicular to the plate major surfaces.

Figure 4B:
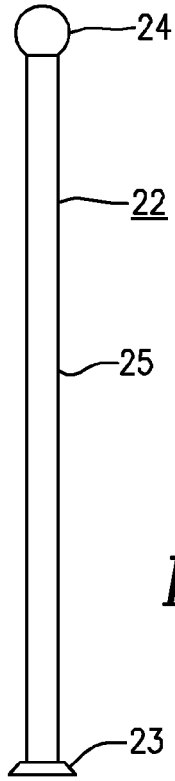
FIG. 4B is an elevation view of one bristle of the hair brush shown in FIGS. 1 and 4A.
Figure 6D:
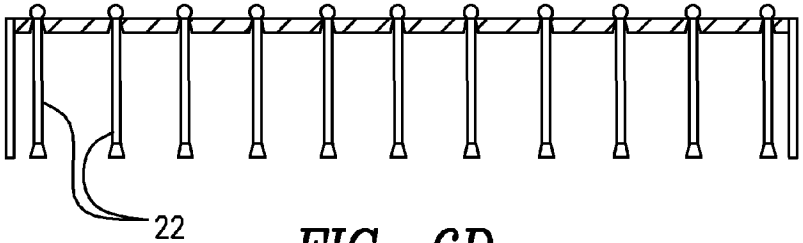
FIG. 6D is a front elevation cross-sectional view of the third embodiment, where the brush base is pre-molded with wedged holes, and bristles are slidable up and down in the brush cavity, and the plate in FIG. 6D pushes up underneath, to hold the bristles in position.
Figure 6E:
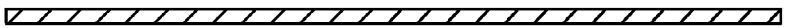
FIG. 6E is a front elevation cross-sectional view of the plate that is pushed up into the cavity shown in FIG. 6D to hold the bristles up in place.
Figure 6F:
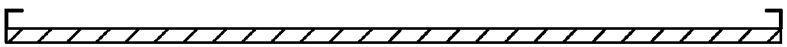
FIG. 6F is a side elevation cross-sectional view of the fourth embodiment, where the bristle retaining plate is slid into place, to look as shown in FIG. 6G.
Figure 6G:
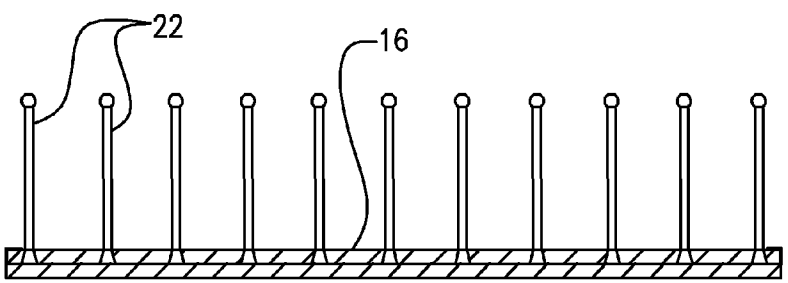
FIG. 6G is a side elevation cross-sectional view of the bristle retaining plate of FIG. 6F being slid into place, with the bristle retaining plate engaging the plate retention recess of the frame of the brush.
Figure 6H:
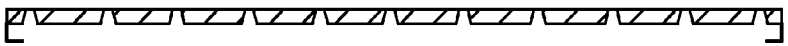
FIG. 6H is a side elevation cross-sectional view of the fifth embodiment, a pre-molded hair brush base with pre-molded holes in the base.
Figure 6I:
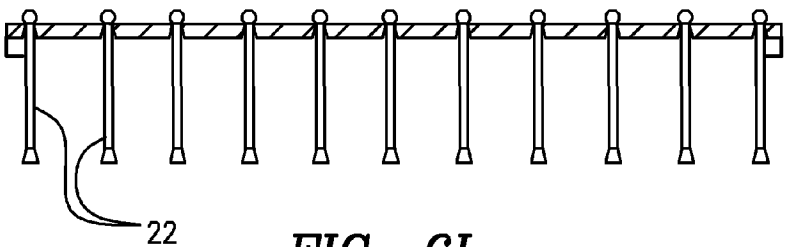
FIG. 6I is side elevation cross-sectional view of the embodiment shown in FIG. 6H with bristles in the pre-molded hair brush base with pre-molded holes; then the solid plate gets slid into the U-shaped grooves while the bristles are in the up position, so that the plate shown in FIG. 6E holds all bristles in the up position.

Disposed in each of the holes 19 is an elongated bendable bristle 22, preferably made of plastic. As best seen in FIG. 4B, each bristle 22 has an enlarged wedge-shaped lower end 23 and an enlarged bulbous other end 24. The diameter of the shaft portion 25 of the bristle is slightly smaller than the inner diameter of a corresponding one of the bristle retaining plate holes 19 into which the bristle is to be inserted. Each bristle is made by forming its shaft portion 25 and wedge-shaped end 23, inserting the bristle through a corresponding hole in the bristle retaining plate 16, and then forming the bulbous end 24. As a result, each bristle is slidably retained by the plate 16, so that the bristle may slide within its corresponding hole 19 between (i) a first position in which the wedge-shaped end is disposed in a chamfer 20 where the hole reaches the lower or recess engaging surface 18 of the plate 16 (FIG. 6, for example), and (ii) a second position in which the bulbous end of the bristle rests upon a land 21 at the upper surface 17 of the plate 16 (FIG. 6D, for example).

As seen in FIGS. 1, 4 and 6, the bristle retaining plate 16 engages the recess 13 in the frame 10 with the lower surface 18 thereof in juxtaposition with the bottom surface 14 of the recess and the wedge-shaped lower ends of the bristles 22 disposed in the chamfers 20 and in contact with the surface 14; the shafts of the bristles extending through respective ones of the holes 19 and protruding from the upper surface 17 of the bristle retaining plate 16; and the bulbous bristle ends 24 being disposed above the upper surface of the plate 16. The bristles 22 are oriented perpendicular to the upper plate surface 17 and therefore are angled outward with respect to the longitudinal axis of the frame.

The hair removal plate 27 has an arcuate shape conforming to that of the upper surface 17 of the bristle retaining plate 16 and has a multiplicity of bristle clearance holes 28 which are coaxial with the bristle retaining holes 19 of the plate 16 when the plate 27 is placed atop the plate 16. Each of the holes 28 has a diameter slightly greater than that of the bulbous top end of the bristle which is in the aligned hole of the plate 16. Therefore when the plate 27 is on the plate 16, each of the bristles 22 extends through one of the holes 19 in the plate 16 and an aligned coaxial hole 28 in the overlying plate 27.

Figure 5A:
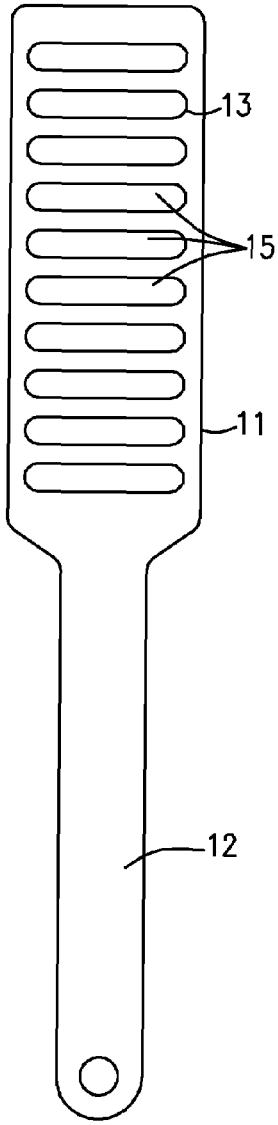
FIG. 5A is a top plan view of the frame of the hair brush shown in FIGS. 1 and 4A.
Figure 5B:
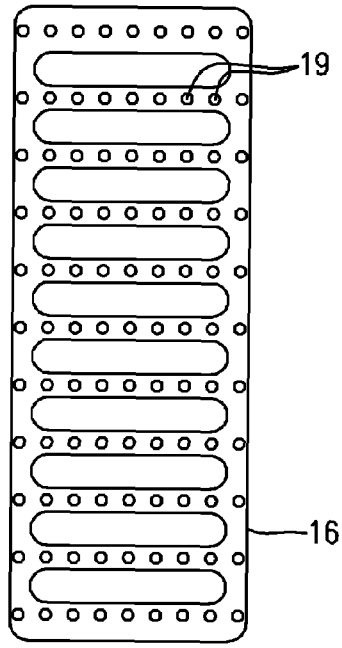
FIG. 5B is a top plan view of the bristle retaining plate of the hair brush shown in FIGS. 1 and 4A.
Figure 5C:
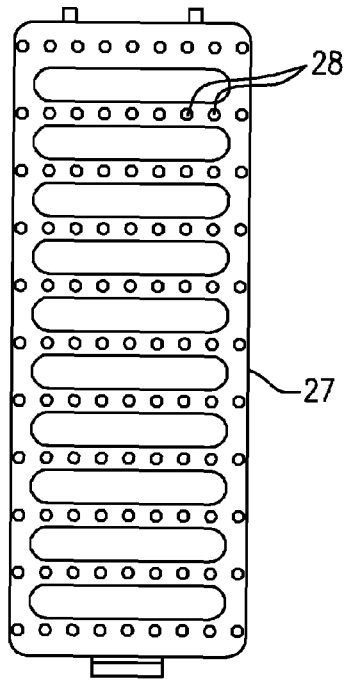
FIG. 5C is a top plan view of the optional hair removal plate of the hair brush shown in FIGS. 1 and 4A.
Figure 5D:
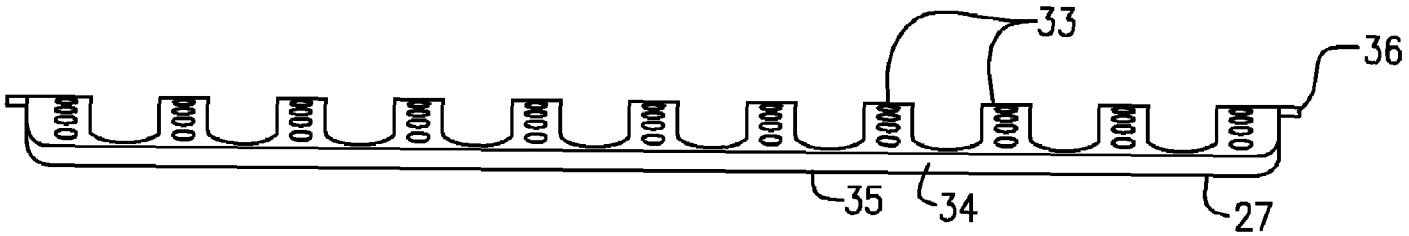
FIG. 5D is a front cross-sectional elevation view of the optional hair removal plate shown in FIG. 5C.
Figure 5E:
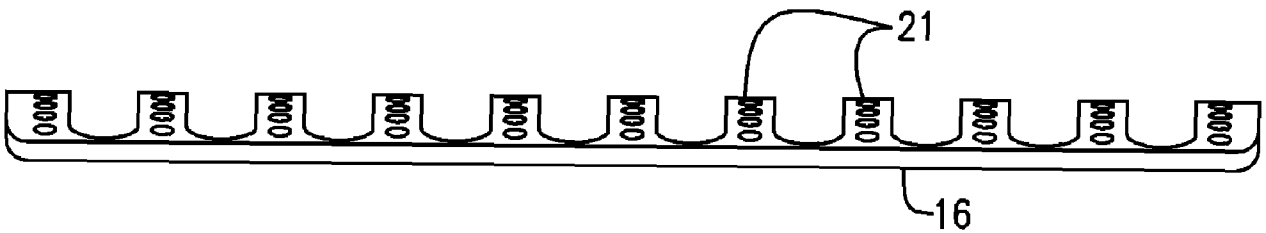
FIG. 5E is front cross-sectional elevation view of the bristle retaining plate shown in FIG. 5B.

As seen in FIG. 5D, the bottom surface 35 of the hair removal plate 27 has chamfers 34 which are shaped to receive corresponding ones of the lands 21 extending upward from the bristle retaining plate 16, so that the plate 27 may sit flush on the plate 16. The upper surface 36 of the plate 27 has lands 33 extending therefrom which provide some guidance of the bristles 22—although this guidance is to a limited extent because the holes through the lands are of slightly greater diameter than the bulbous ends 24 of the bristle shafts and therefore of somewhat greater diameter than the shafts themselves.

The hair removal plate 27 may be used to keep the bristle retaining plate 16 in engagement with the recess 13 of the frame 10, by disposing the hinge prongs 29, which extend from one edge of the plate 27, in the hinge slot 30 and rotating or pivoting the plate 27 until the resilient latch member 31 which extends from an opposite edge of the plate engages a lip 32 adjacent an edge of the recess 13. The hair removal plate 27 may be removed by releasing the latch member 31 from the lip 32 and pivoting or rotating the plate about the hinge slot 30, and then pulling the plate 27 away from the slot.

The frame is preferably made of a relatively rigid plastic such as polystyrene or acrylonitrile-butadiene-styrene ("ABS"). The plates 16 and 27 are preferably made of a metal and formed to have some resilience, although rigid plates will also provide proper functioning. Suitable metals are aluminum and stainless steel. Alternatively, a strong plastic, preferably one exhibiting some resilience, could be used.

Where a somewhat resilient bristle retaining plate 16 is used, the plate and the recess 13 may alternatively be configured so that the width of the recess is slightly less than the distance between the longitudinal edges of the plate, and the plate can be bent slightly and then released, to cause it to selectively engage and disengage adjacent walls of the recess; which wall may if desired be provided with inwardly extending longitudinal lips to help retain the plate 13 in position. With this arrangement the hair removal plate 27 can, if so desired, be dispensed with.

Figure 7B:
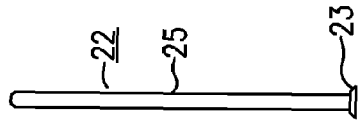
FIG. 7B is an elevation view showing the final shape of a bristle after it has been installed in the bristle retaining plate shown in FIG. 7.
Figure 7C:
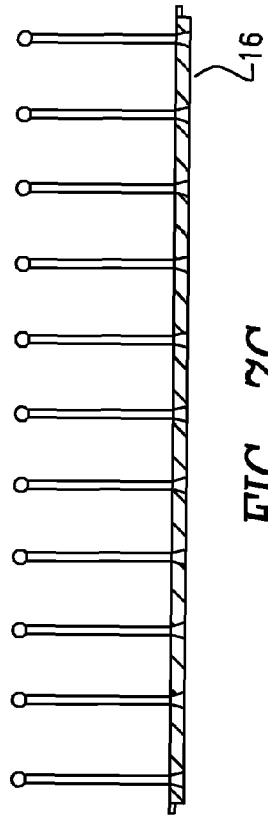
FIG. 7C is a side cross-sectional elevation view of the bristle retaining plate shown in FIG. 7, with bristles installed therein, in the position of said bristles when the retaining plate is engaged with the recess of the brush frame.
Figure 7:
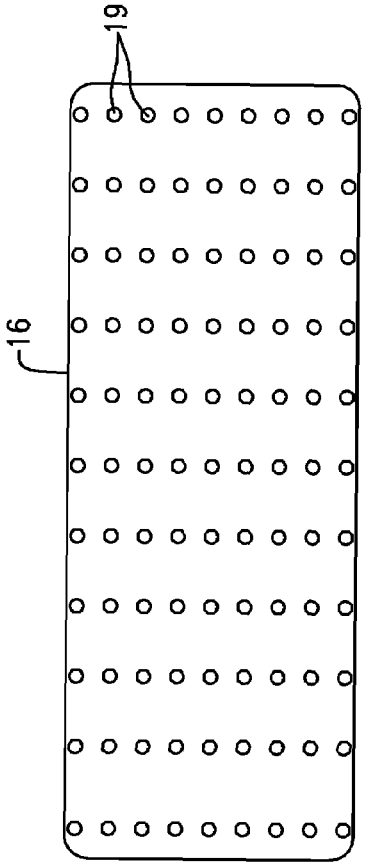
FIG. 7 is a top plan view of the bristle retaining plate of the hair brush shown in FIGS. 1, 4A and 6.
Figure 7A:
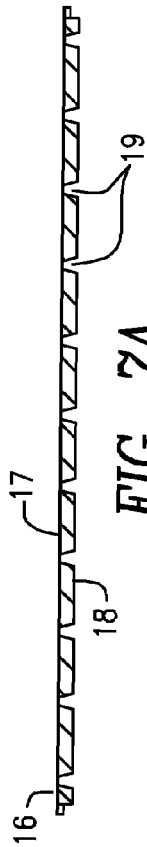
FIG. 7A is a side elevation cross-sectional view of the bristle retaining plate shown in FIG. 7.
Figure 7D:
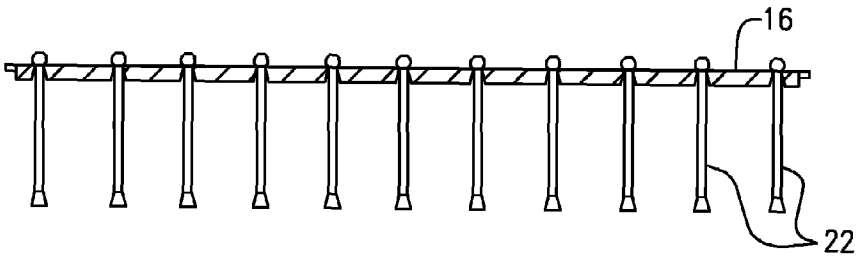
FIG. 7D is a side cross-sectional elevation view of the bristle retaining plate shown in FIG. 7, with bristles installed therein, in the position of said bristles when the retaining plate is disengaged from the recess of the brush frame.
Figure 7E:
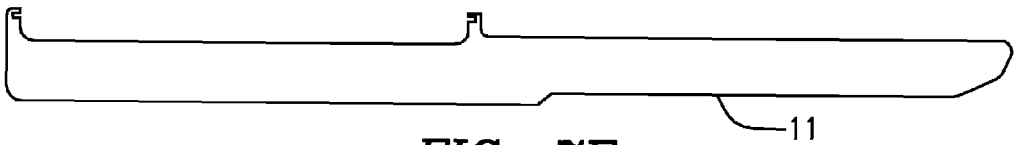
FIG. 7E is a side cross-sectional elevation view of the frame of the hair brush shown in FIGS. 1, 4A and 6, without the bristle retaining plate or the optional hair removal plate.
Figure 7F:
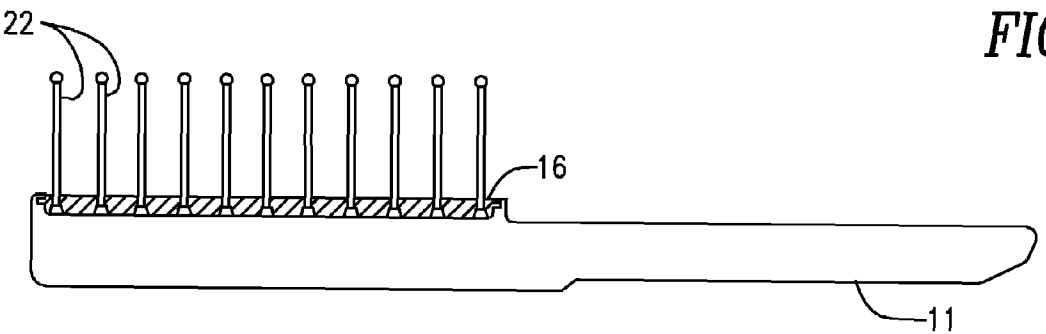
FIG. 7F is a side cross-sectional elevation view of the frame of the hair brush shown in FIGS. 1, 4A and 6, without the optional hair removal plate.

To remove hair from the brush 10, the hair removal plate 27, if present, is first removed as previously described. Then the bristle retaining plate 16 with its bristles 22 is removed from the recess 13 and turned so that the bristles may slide through the holes 19 to a position where their bulbous tips 24 rest on the upper plate surface 17, as shown in FIG. 7D. Then the plate 16, while being kept in this position, is inserted into the recess 13 of the frame 10, and held in place either by means of a hair removal plate 27 or by engagement of the longitudinal edges of the plate with walls or lips of the recess 13.

In the alternative embodiment shown in FIGS. 8A through 8C, elements which are similar to those of the embodiment shown in FIGS. 1 through 7F are identified by the same numerals followed by the letter "a".l The hair brush 10*a* shown in FIGS. 8A through 8C has a body portion 11*a* and a handle 12*a*. A recess 13*a* in the body portion receives a bristle retaining plate 16*a*, one end of which is permanently hinged to the body portion adjacent the recess 13 by a hinge 36 comprising a flexible material such as vinyl plastic, rubber or leather. A latch member 31*a* on the edge of the plate 16*a* opposite the hinge 36 detachably engages a lip of the body portion 11*a* adjacent the recess 13*a*. With this arrangement a hair removal plate such as the plate 27 is unnecessary.

When the latch 31*a* is released and the plate 16*a* is partially rotated away from the body portion 11*a* of the brush 10*a*, the bristles 16*a* begin to slide or fall down through the corresponding holes in the plate (being slightly pushed if necessary) so that any hair on the bristles is removed and the bulbous ends 24*a* of the bristles approach the upper plate surface 17*a*, as shown in FIG. 8A.

When the brush is inverted as shown in FIG. 8B, the bristles fall completely down through the holes in the opposite direction so that their wedge-shaped ends 23*a* become disposed in corresponding ones of the chamfers 20*a*.

Then the plate 16*a* is rotated or pivoted about the hinge 36 until the latch member 31*a* engages the lip 37, thus returning the plate 16*a* to its original position within the recess 13*a*.

I claim:

1. A hair brush including hair removal means, comprising:

a hair brush frame having a handle portion and a body portion;

an arcuate bristle retaining plate having a multiplicity of bristle receiving holes extending between a frame recess engaging major surface and an upper major surface of the plate, each of said holes having a chamfer adjacent the frame recess engaging major surface of said bristle retaining plate;

the body portion of said frame having a recess adapted to receive said bristle retaining plate, said recess having an arcuate bottom surface adapted to contact said frame recess engaging major surface of said bristle retaining plate; and an elongated generally cylindrical bendable bristle slidably disposed in each of said holes of said bristle retaining plate, each bristle having a wedge-shaped frame engaging end adjacent said recess engaging major surface and an enlarged bulbous other end adjacent said upper major surface of said bristle retaining plate, each of said ends having a diameter greater than the diameter of the corresponding hole, so that each bristle may slide within the corresponding hole until one of said ends engages an adjacent major surface of said bristle retaining plate, said wedge shaped end of each bristle being dimensioned so as to engage the chamfer of the corresponding hole when the recess engaging major surface of the bristle retaining plate is in contact with the arcuate bottom surface of said recess;

whereby the bristle retaining plate can be removed from the recess of said hair brush frame to facilitate removal of hair from said bristle retaining plate and bristles, and wherein when the retaining plate is held in one position, the bristles may slide through the corresponding holes in the bristle retaining plate until the bulbous ends engage the upper major surface of the bristle retaining plate, and when the bristle retaining plate is inverted the bristles may slide through the corresponding holes in the bristle retaining plate until the wedge-shaped ends engage the chamfers of the corresponding holes in the bristle retaining plate so as to facilitate re-engagement of the recess engaging surface of the bristle retaining plate with the recess in the body portion of the brush frame.

2. A hair brush according to claim 1, further comprising an arcuate hair removal plate adapted to engage the recess in said hair brush frame when positioned atop said bristle retaining plate, said hair removal plate having a multiplicity of bristle receiving holes arrayed so as to coincide with the bristle receiving holes of the bristle retaining plate when said plates are in juxtaposition with each other, each hole of said hair removal plate having a diameter slightly greater than the diameter of the bulbous end of the bristle extending through the coinciding hole of the bristle retaining plate, so that the hair removal plate can be disengaged from the recess in the hair brush frame and moved away from the bristle retaining plate so that the bulbous ends of the bristles pass through the corresponding holes in the hair removal plate to remove hair from the brush, after which the hair removal plate can again be positioned atop the bristle retaining plate with each bristle passing through a bristle receiving hole in the bristle retaining plate and a coinciding hole in the overlying hair removal plate.

3. The hair brush according to claim 2, further comprising means for securing the bristle retaining plate adjacent the recess of the hair brush frame, said securing means comprising:

a hinge for rotatably coupling at least a portion of one edge of said bristle retaining plate to said frame adjacent said recess; and a latch for detachably securing at least a portion of an opposite edge of said bristle retaining plate to said frame adjacent said recess, whereby when the latch is released the bristle retaining plate may be rotated about the hinge to permit the bristles to slide through the bristle retaining plate.

4. The hair brush according to claim 1, further comprising means for securing the bristle retaining plate adjacent the recess of the hair brush frame, said securing means comprising:

a hinge for rotatably coupling at least a portion of one edge of said bristle retaining plate to said frame adjacent said recess; and a latch for detachably securing at least a portion of an opposite edge of said bristle retaining plate to said frame adjacent said recess, whereby when the latch is released the bristle retaining plate may be rotated about the hinge to permit the bristles to slide through the bristle retaining plate.

5. A hair brush including hair removal means, comprising:

a hair brush frame having a recess;

an arcuate bristle retaining plate adapted to engage said recess, said plate having a multiplicity of bristle receiving holes extending between a frame recess engaging major surface and an upper major surface of the plate, said recess having an arcuate bottom surface adapted to contact said frame recess engaging major surface of said bristle retaining plate; and an elongated generally cylindrical bendable bristle slidably disposed in each of said holes of said bristle retaining plate, each bristle having an enlarged frame engaging end adjacent said recess engaging major surface and an enlarged bulbous other end adjacent said upper major surface of said bristle retaining plate, each of said ends having a diameter greater than the diameter of the corresponding hole, so that each bristle may slide within the corresponding hole until one of said ends engages an adjacent major surface of said bristle retaining plate;

whereby the bristle retaining plate can be disengaged from the recess of said hair brush frame to facilitate removal of hair from said bristle retaining plate and bristles, and wherein when said plate is disengaged from said recess the bristles may slide through the corresponding holes in the bristle retaining plate until the bulbous ends engage the upper major surface of the bristle retaining plate, and may also slide through the corresponding holes in the bristle retaining plate until the frame engaging ends engage the corresponding holes in the bristle retaining plate so as to facilitate reengagement of the recess engaging surface of the bristle retaining plate with the recess in the brush frame.

6. The hair brush according to claim 5, wherein each of the holes through the bristle retaining plate has a chamfer adjacent the frame recess engaging major surface thereof, and each bristle has a wedge-shaped frame engaging end.

7. The hair brush according to claim 6, further comprising means for securing the bristle retaining plate adjacent the recess of the hair brush frame, said securing means comprising:

a hinge for rotatably coupling at least a portion of one edge of said bristle retaining plate to said frame adjacent said recess; and a latch for detachably securing at least a portion of an opposite edge of said bristle retaining plate to said frame adjacent said recess, whereby when the latch is released the bristle retaining plate may be rotated about the hinge to permit the bristles to slide through the bristle retaining plate.

8. A hair brush including hair removal means, comprising:

a hair brush frame having an arcuate surface portion;

an arcuate bristle retaining plate having a frame engaging major surface conforming to the shape of said arcuate surface portion and adapted to overlie the same, said plate having a multiplicity of bristle receiving holes extending between the frame engaging major surface and an upper major surface of the plate;

an elongated generally cylindrical bendable bristle slidably disposed in each of said holes of said bristle retaining plate, each bristle having an enlarged frame engaging end adjacent said frame engaging major surface and an enlarged bulbous other end adjacent said upper major surface of said bristle retaining plate, each of said ends having a diameter greater than the diameter of the corresponding hole, so that each bristle may slide within the corresponding hole until one of said ends engages an adjacent major surface of said bristle retaining plate; and means for securing said bristle retaining plate to said frame with the frame engaging major surface thereof disposed in juxtaposition with the arcuate surface portion of the frame, whereby the bristle retaining plate can be disengaged from the hair brush frame to facilitate removal of hair from said bristle retaining plate and bristles, and wherein when said plate is disengaged from said frame the bristles may slide through the corresponding holes in the bristle retaining plate until the bulbous ends engage the upper major surface of the bristle retaining plate, and may also slide through the corresponding holes in the bristle retaining plate until the frame engaging ends engage the corresponding holes in the bristle retaining plate so as to facilitate re-positioning of the frame engaging surface of the bristle retaining plate in juxtaposition with the arcuate portion of the brush frame.

9. The hair brush according to claim 8, wherein the frame engaging ends of the bristles contact the arcuate surface portion of the frame and the bristles extend outward from the upper major surface of the bristle retaining plate in directions generally perpendicular to said upper major surface.

10. The hair brush according to claim 9, further comprising an arcuate hair removal plate having a multiplicity of holes therethrough coinciding with corresponding holes through the bristle retaining plate, said hair removal plate conforming to the shape of, and overlying said bristle retaining plate, each bristle extending through a hole of the hair removal plate, each hole of the hair removal plate having a diameter slightly greater than the diameter of the bulbous end of the bristle extending through that hole, so that the hair removal plate may be slidably removed from the bristle retaining plate to remove hair from the brush; and means for detachably securing the hair removal plate in juxtaposition with the bristle retaining plate.

* * * * *